US008984709B1

(12) United States Patent
Rollins

(10) Patent No.: US 8,984,709 B1
(45) Date of Patent: Mar. 24, 2015

(54) NO-ENTRY BULK OIL STORAGE TANK CLEANING SYSTEM

(76) Inventor: John K. Rollins, Nampa (CA)

( * ) Notice: Subject to any disclaimer, the term of this patent is extended or adjusted under 35 U.S.C. 154(b) by 820 days.

(21) Appl. No.: 13/317,606

(22) Filed: Oct. 25, 2011

(51) Int. Cl.
*A47L 11/00* (2006.01)
*B08B 9/08* (2006.01)

(52) U.S. Cl.
CPC .. *A47L 11/00* (2013.01); *B08B 9/08* (2013.01)
USPC ..... 15/321; 15/314; 15/315; 15/339; 134/21; 134/22.15; 134/22.18; 134/24; 134/167 R

(58) Field of Classification Search
CPC ..... A47I 11/00; B08B 9/00; B08B 9/08; B08B 9/093; B08B 2230/01; B65B 55/02; E03F 9/00
USPC ..... 15/320, 321, 314, 315, 339; 134/21, 134/22.1, 22.15, 22.18, 24, 167 R
IPC ..... A47L 11/00
See application file for complete search history.

(56) References Cited

U.S. PATENT DOCUMENTS

| | | | | |
|---|---|---|---|---|
| 4,817,653 | A * | 4/1989 | Krajicek et al. | 134/168 R |
| 5,293,887 | A * | 3/1994 | Thibodeaux | 134/24 |
| 6,069,002 | A * | 5/2000 | Powell, Jr. | 435/264 |
| 2011/0315164 | A1 * | 12/2011 | DesOrmeaux | 134/21 |

* cited by examiner

*Primary Examiner* — David Redding
(74) *Attorney, Agent, or Firm* — Edwin H. Crabtree; Ramon L. Pizawo

(57) ABSTRACT

A tank cleaning system used for cleaning oil storage tanks. The system includes a rail vacuum pipe, an air line and a steam line connected to an air/steam mixing box. The mixing box includes an air nozzle, a steam nozzle and a mixing box vacuum tube connected to a vacuum pipe. The vacuum pipe includes a steering, guide rail for receiving a swivel wheel. The swivel wheel is attached to a door opening bracket. The bracket is attached to sides of a tank door opening. The steering, guide rail pivots on the swivel wheel and allows an operator, standing outside the tank, to move the mixing box back and forth for engaging and vacuuming up sediment in the tank.

16 Claims, 3 Drawing Sheets

NO-ENTRY BULK OIL STORAGE TANK CLEANING SYSTEM

BACKGROUND OF THE INVENTION (a) Field of the Invention

This invention relates to the cleaning of large storage tanks, and more particularly, but not by way of limitation, to the cleaning of a bulk oil storage tank and removing sediments from the bottom of the tank.

(b) Discussion of Prior Art

Heretofore, large bulk oil storage tanks, ranging in size from 400 to 40,000 plus barrels of crude oil, have been cleaned periodically to check the integrity of the tank structure and maintain usable capacity of the tank by removing sediments from the crude oil, such as sand, clay, water, heavy oil and sludge. Also the build up of the sediments in the tank can plug an oil discharge line, when oil is pumped out of the tank to be delivered to an oil refinery.

Currently during the bulk tank cleaning process, one or two workmen enter the inside of the large tank through a removable, manway door in the side of the tank. At this time, high pressure water is introduced through a water jet pipe or a water cannon into the sediment creating a water and sediment slurry. The water and sediment slurry is then vacuumed into a vacuum truck tank and carried to a disposal site. Inside the tank and during the mixing of the high pressure water with the sediment to create a water and sediment slurry, dangerous gases occur. The breathing of these gases can easily cause illness or death to the workman who fails to wear a self-contained breathing apparatus, provided by an oil tank, safety consultant. Because of the added expense, oil and gas companies may or may not hire the safety consultant with the required breathing equipment for their workmen.

The subject no-entry, tank cleaning system eliminates the need for one or two workmen to enter the inside of the storage tank and risk breathing dangerous gases. Also, the cleaning system eliminates the high cost of added water delivery trucks, an added water pressure pumping truck and having to hire the air safety consultant with air safety equipment.

SUMMARY OF THE INVENTION

In view of the foregoing, it is a primary objective of the subject invention to provide a tank cleaning system which eliminates the need for workmen to enter the inside of a bulk oil storage tank and running the risk of breathing noxious gases, when removing sediment from the floor of the tank.

Another key object of the invention is the cleaning system greatly reduces the cost of removing sediments from inside the tank by eliminating the need for one or more water tank trucks, a water pressure pumping truck, and a tank air safety consultant with breathing equipment.

Still another object of the invention is the cleaning system greatly reduces the time to clean a bulk storage oil tank and reduces the cost of sediment disposal by eliminating the need for creating large amounts of a water and sediment slurry mixture using prior art water jets or water cannons.

The subject tank cleaning system includes a vacuum pipe connected to a vacuum truck via a flexible hose, a high pressure air line and a high pressure steam line connected to an air/steam mixing box. The mixing box includes an air nozzle connected to the air line, a steam nozzle connected to the steam line and a suction head of a vacuum tube. The vacuum hose includes a steering, guide rail mounted thereon for receiving a swivel wheel. The swivel wheel is attached to a door opening bracket. The door opening bracket is attached to opposite sides of a manway door opening in a side of the tank. The steering, guide rail pivots on the swivel wheel and allows an operator to move the mixing box back and forth, left and right for engaging and vacuuming up the sediment in the bottom of the storage tank. The system also includes a wheel mounted, finish suction head with high pressure air nozzles, high pressure steam nozzles and a suction head of the vacuum tube. The finish suction head is used to complete the cleaning of the remaining sediment left on the floor of the tank.

These and other objects of the present invention will become apparent to those familiar with the cleaning of sediment in large bulk oil storage tanks when reviewing the following detailed description, showing novel construction, combination, and elements as herein described, and more particularly defined by the claims, it being understood that changes in the embodiments of the disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of subject tank cleaning system, and in which.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

DETAILED DESCRIPTION OF THE PREFERRED EMBODIMENTS

Figure 1:
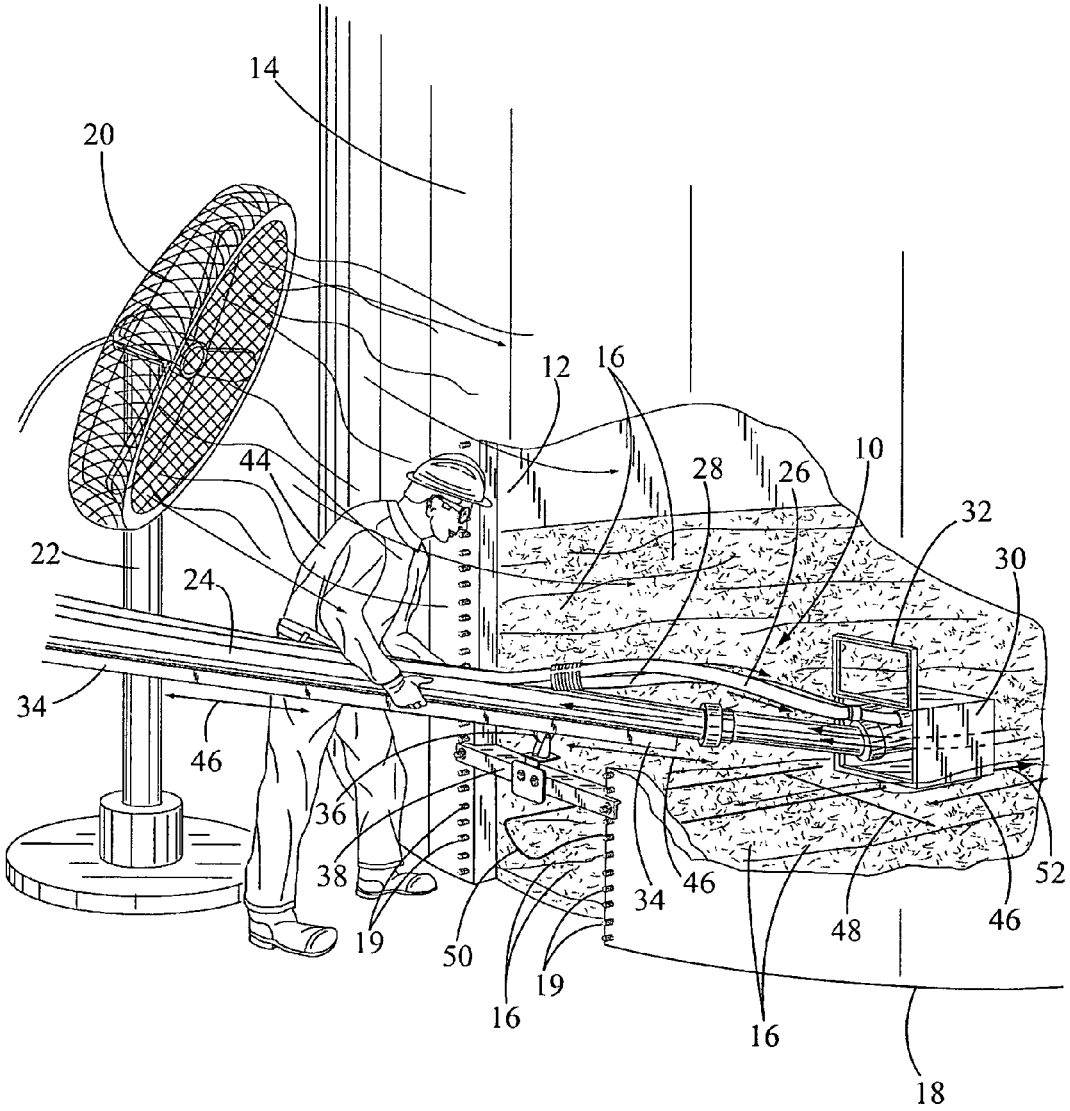
FIG. 1 is a perspective view of subject tank cleaning system in operation and received through a door opening in the side of a large, bulk oil storage tank.

In FIG. 1, a perspective view of subject tank cleaning system is shown having a general reference numeral 10. The cleaning system 10, in this embodiment, is shown received through a door opening 12 in the side of a large, bulk oil storage tank 14. A portion of the opening 12 and the tank 14 have been cutaway to illustrate sediment 16, which may accumulate up to a foot in a bottom 18 of the tank. The door opening 12 is covered by a door, which can be a single door or a two-part door. In this drawing, the door has been unbolted from outwardly extending, threaded studs 19, equally spaced along a length of the sides of the opening 12 and removed. A large fan 20 mounted on a stand 22 and disposed next to the door opening 12 can be used for added safety to circulate air into the tank and keep any potential gas vapors, generated by the cleaning system 10, left inside the tank. Also and in the alternative, a suction hose can be attached to a vent in the top of the storage tank to vacate gas fumes, thus providing a positive, clean air induction at the door opening for further protection of the system's operator.

The cleaning system 10 includes a 4 inch, rail vacuum pipe 24, a high pressure air line 26, typically 110 psi, and a high pressure steam line 28, typically operating at 110 psi and at 300 degrees F., connected to an 8 inch by 8 inch square, air/steam mixing box 30 with a handle 32. The air line 26 is connected to an air compressor and the steam line 28 is connected to a steam generator. The rail vacuum pipe 24 is connected to a high volume, vacuum truck via a flexible hose. The high volume vacuum is typically 1200 cfm. The compressor, steam generator and vacuum truck aren't shown in the drawings. While the various dimensions, geometric configurations, pressure and temperature are mentioned above, it should be kept in mind that these features may vary without departing from the spirit and scope of the invention A 2 inch, inverted "U" shaped, steering guide rail 34 is mounted along the bottom and a portion of the length of the rail vacuum pipe 24. A two inch swivel wheel 36 is mounted on a door opening bracket 38, having opposite flange ends 40 and 42, shown in FIG. 4, bolted to the sides of the door opening 12. The swivel wheel 36 rides in the guide rail 34 and allows a workman 44 to move the cleaning system 10 back and forth, as indicated by arrows 46 and sideways, as indicated by arrow 48, for ease in manipulating the mixing box 30 and covering the bottom of the tank, when vacuuming the sediment inside the tank.

Figure 3:
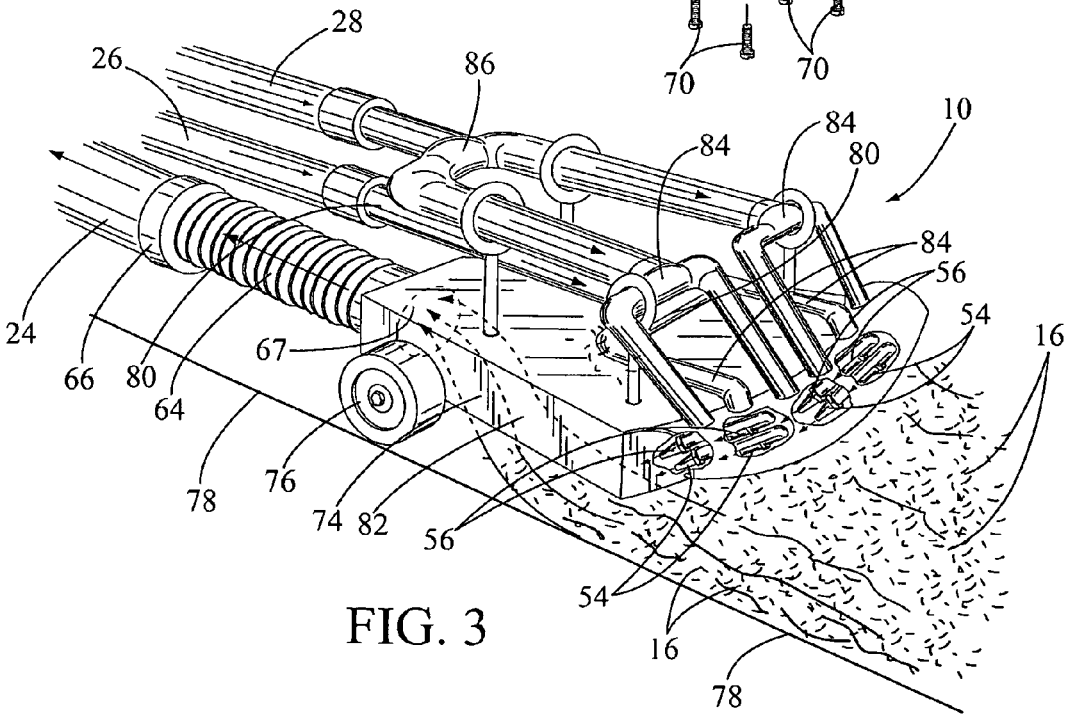
FIG. 3 is a perspective view of a wheel-mounted, finish suction head, with high pressure air and steam nozzles and an end portion of the vacuum tube.

In operation and for example, the tank 14 may have from 10 to 24 inches and greater of the semi-solid, sediment 16 prior to cleaning. In this drawing, the air/steam mixing box 30 is used to loosen and vacuumed up the top 20 to 22 inches of sediment. The remaining 2 to 4 inches can be vacuumed up using a wheel mounted, floor finishing head. The finishing head is shown in FIG. 3. As the mixing box 30 moves inward from the door opening 12 into the tank 14, the air/steam mixture dissolves the semi-solid sediment. The sediment then drops downwardly and is sucked into the mixing box leaving a "V" shaped pattern 50 in the sediment to be picked up during the next cleaning pass by the mixing box. The forward direction of the mixing box 30 is indicated by arrow 52. As mentioned above, the mixing box 30 can be moved forward and side to side, as indicated by arrows 46 and 48, and until the majority of the sediment 16 is removed using the air and steam mixture and the rail vacuum pipe 24 for removing the sediment from inside the tank 14.

It should be mentioned that using, for example 750 cfm of high pressure air and steam, the mixture of air and steam to remove the sediment is far less expense and far more efficient then using steam alone, which takes up to 5 times longer. Also, using air alone takes longer and the air tends to create balls of sediment making it difficult to vacuum. Another advantage of the air and steam mixture is the sediment is reduced to small grains of sand and clay for ease in vacuuming. Further, the use of air and steam eliminates the high cost of using large volumes of water and the high cost of disposing of large amounts of the water and sludge slurry.

Figure 2:
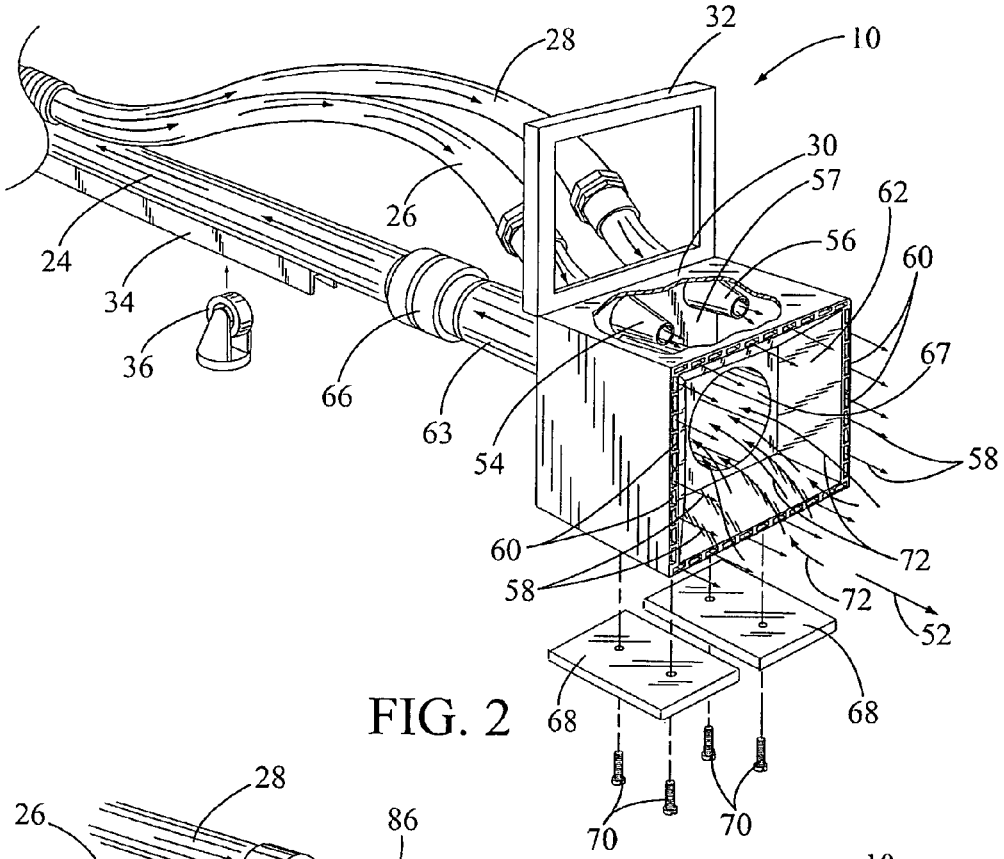
FIG. 2 is a perspective view of an air/steam mixing box with high pressure, air and steam nozzles and an end portion of a vacuum tube centered in the front of the mixing box for receiving sediment loosened by an air and steam mixture.

In FIG. 2, a perspective view of the air/steam mixing box 30 is shown in greater detail. In this drawing a portion of the top of the mixing box 30 has been cutaway to illustrate an air nozzle 54 and a steam nozzle 56. The two nozzles are mounted in the rear of the enclosed mixing box, and connected to the air and steam lines 26 and 28. The enclosed mixing box 30 creates an internal, air and steam mixing chamber 57. The mixing chamber 57 is important in that it acts to regulate air and steam pressure should there be a pressure differential between the high pressure air and the high pressure steam coming out of the nozzles 54 and 56. Also, the mixing chamber 57 provides for a mixture of the air and steam, shown as arrows 58, which exits out a plurality of 1/16 inch wide, air/steam mixture slits 60. The mixture slits 60 can be in a range of ½ to 1 inch in length and are disposed around a periphery of a square-shaped, concave-shaped front portion 62.

The mixing box 30 also includes a mixing box vacuum tube 63, similar in diameter to the rail vacuum pipe 24, connected to a camlock coupling 66. The coupling 66 is used for connecting the vacuum tube 63 to the rail vacuum pipe 24. A suction head 67 of the vacuum tube 63 is centered in the concave-shaped front portion 62 for receiving the sediment 16, as it's loosened by the high pressure air and steam mixture 58 and sucked into the vacuum tube 63, as indicated by arrows 72.

Further, the mixing box 30 includes a pair of Teflon pads 68 with screws 70 used for securing the pads to the bottom of the box. The Teflon pads 68 provide for ease in moving the mixing box 30 into the sediment 16 and prevent a potential spark ignition of gas fumes, that might be generated during the tank cleaning operation.

In FIG. 3, a perspective view of another embodiment of the subject tank cleaning system 10 is illustrated. In this drawing, a floor finishing head 74 is shown mounted on a pair of wheels 76. As mentioned above, the finishing head 74 is used to remove the last 2 or 3 inches of sediment 16 on a tank floor 78 and prior to completing the tank cleaning operation. The wheels 76 help move the finishing head 74 back and forth on the cleaned tank floor 78 as the remaining sediment 16 is removed.

In this example, the air line 26 is connected to an air manifold 80 mounted on a top of a finishing head housing 82. A pair of ends 84 of the air manifold 80 are attached to four air nozzles 54, with the ends of the nozzles received through the housing 82 and angled rearwardly, typically at an angle of 45 degrees from the vertical, for directing the loosened sediment 16 toward the suction head 67 of a semi-flexible, vacuum hose 64 attached to the rear of the housing.

Also, the steam line 18 is connected to a steam manifold 86 mounted on top of the finishing head housing 82. A pair of ends 84 of the steam manifold 86 are attached to four steam nozzles 56, with the ends of the nozzles received through the housing 82 and angled rearwardly, also at a 45 degree angle from the vertical, for directing the loosened sediment 16 toward the suction head 67 of the semi-flexible, vacuum hose 64. In this manner, the air and steam in combination, using a plurality of air and steam nozzles, can be used to remove the last few inches of the sediment 16 from the tank floor 78 and directing the sediment into the vacuum hose 64 attached to the rail vacuum pipe 24, using another camlock coupling 66. Also, an added feature of the floor finishing head is the steam line 28 can be turned off. At this time, the air line 26 can be used alone with the vacuum tube 63 for cleaning up any remaining steam turned to water or sediment left on the tank floor 78.

Figure 4:
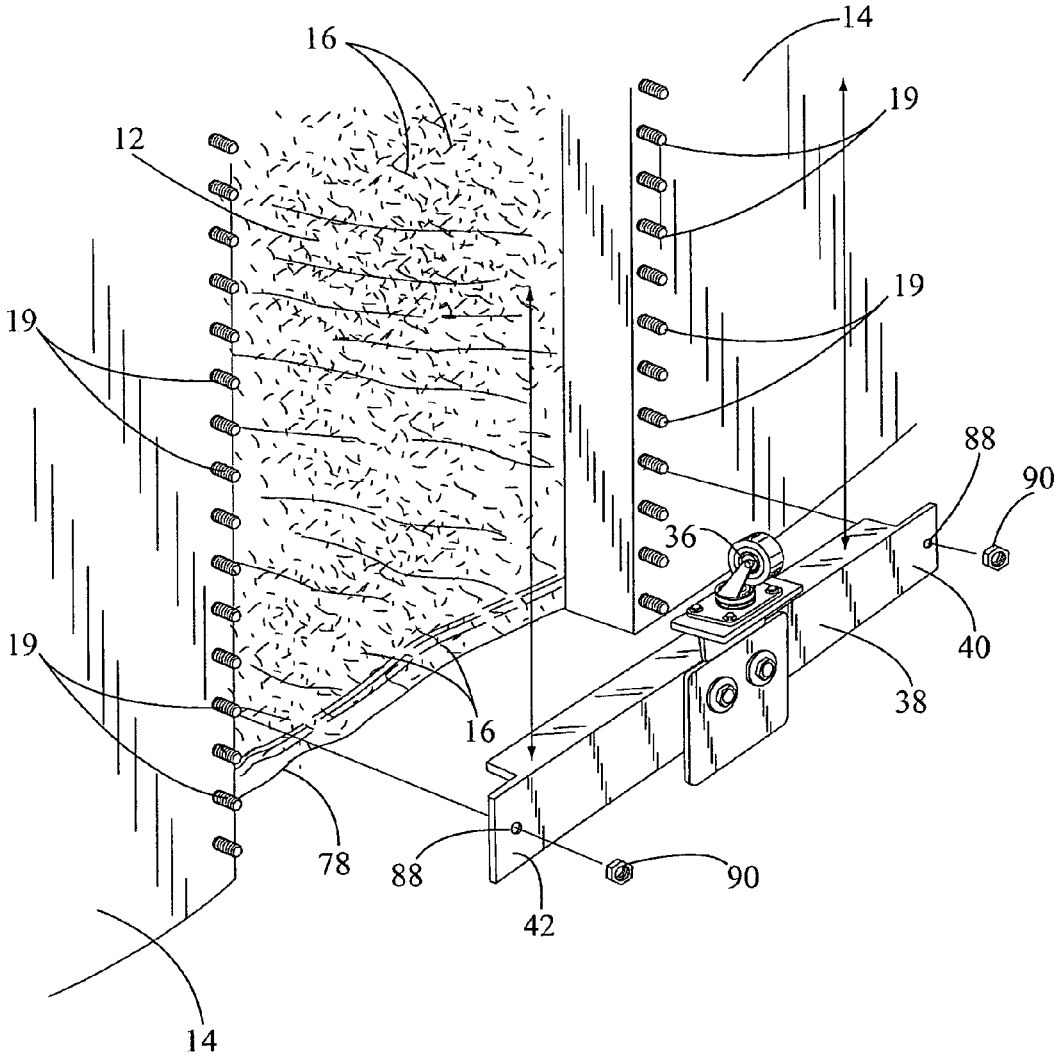
FIG. 4 is a perspective view of a swivel wheel mounted on a door mounting bracket. Opposite ends of the mounting bracket are attached to sides of the manway door opening.

In FIG. 4, an enlarged perspective view of a swivel wheel 36 and door opening bracket 38 are shown. In this drawing, stud holes 88, in the opposite flange ends 40 and 42 of the mounting bracket 38, are shown ready to be received around the outwardly extending, threaded studs 19, equally spaced along the length of the sides of the door opening 12. The mounting bracket 38 is the attached to the thread studs 19 using bolts 88. The bracket 38 can have different configurations and attached to sides of the door opening, typically 1 to 2 feet above the tank floor 78 for ease in moving either the air/steam mixing box 30 or the floor finishing head 74 attached to the air and steam lines 26 and 28 and the vacuum pipe 24 inside the tank 14.

While not shown in the drawings, the inside walls of the storage tank 14 can be cleaned using a bent 1 inch steam pipe with an insulated handle. The pipe can be held on top of a chain, with opposite ends of the chain attached to the sides of the door opening 12. In this manner, the weight of the steam pipe rest on the chain and the operator can move the pipe back and forth on the chain for steam cleaning the tank walls.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follows:

1. A no-entry bulk oil storage tank cleaning system adapted for receipt through a door opening in a side of a storage tank and removing sediment in a bottom of the tank, for safety, the operator of the cleaning system remains outside the storage tank and next to the door opening, the cleaning system comprising:

an air line adapted for delivering high pressure air inside the tank;

a steam line adapted for delivering high pressure and high temperature steam inside the tank; and a rail vacuum pipe adapted for delivering a large vacuum inside the tank;

a mixing box adapted for receipt through the door opening and engaging the sediment, the mixing box including an air nozzle attached to the air line, a steam nozzle attached to the steam line and a mixing box vacuum tube connected to the rail vacuum pipe;

whereby when the high pressure air and the high pressure steam are received in the mixing box, the air and steam mixture exits out the front of the mixing box for engaging and loosening the sediment, the mixing box vacuum tube vacuuming the loosened sediment into the rail vacuum pipe; and means for guiding the mixing box with attached air and steam lines and mixing box vacuum tube back and forth and side to side inside the tank.

2. The cleaning system as described in claim 1 wherein the mixing box includes a front portion with a plurality of air and steam openings therein for discharging the air and steam mixture into the sediment during the tank cleaning operation.

3. The cleaning system as described in claim 2 wherein the front portion of the mixing box has a concave-shape with a suction head of the mixing box vacuum tube centered therein for receiving the loosened sediment.

4. The cleaning system as described in claim 1 wherein the mixing box includes an air and steam mixing chamber therein for receiving and mixing together the high pressure air and the high pressure steam prior to exiting out the front of the mixing box.

5. The cleaning system as described in claim 1 wherein the mixing box includes at least one Teflon pad mounted on a bottom of the mixing box for preventing a potential spark and igniting gas fumes inside the tank during the tank cleaning operation.

6. The cleaning system as described in claim 1 wherein the means for guiding the mixing box includes a steering guide rail mounted along a length of the rail vacuum pipe and a swivel wheel mounted on door opening bracket, the door opening bracket adapted for attachment to opposite sides of the door opening, the steering guide rail received on the swivel wheel and moved back and forth thereon during the operation of the tank cleaning system.

7. A no-entry bulk oil storage tank cleaning system adapted for receipt through a door opening in a side of a storage tank and removing sediment in a bottom of the tank, for safety, the operator of the cleaning system remains outside the storage tank and next to the door opening, the cleaning system comprising:

an air line adapted for delivering high pressure air inside the tank;

a steam line adapted for delivering high pressure and high temperature steam inside the tank; and a rail vacuum pipe adapted for delivering a large vacuum inside the tank, a portion of the air line and a portion of the steam line attached to the rail vacuum pipe;

a mixing box adapted for receipt through the door opening and engaging the sediment, the mixing box including an air nozzle attached to the air line, a steam nozzle attached to the steam line and a mixing box vacuum tube connected to the rail vacuum pipe;

whereby when the high pressure air and the high pressure steam are received in the mixing box, the air and steam mixture exits out the front of the mixing box for engaging and loosening the sediment, the mixing box vacuum tube vacuuming the loosened sediment into the rail vacuum pipe; and an inverted "U" shaped, steering guide rail mounted along a length and on a bottom of the rail vacuum pipe and a swivel wheel mounted on a door opening bracket, the door opening bracket adapted for attachment to opposite sides of the door opening, the steering guide rail received on the swivel wheel and moved back and forth thereon during the operation of the tank cleaning system.

8. The cleaning system as described in claim 7 wherein the mixing box includes a square-shaped, front portion with a plurality of air and steam slits disposed around the periphery of the front portion for discharging the air and steam mixture into the sediment.

9. The cleaning system as described in claim 8 wherein the front portion of the mixing box has a concave-shape with a suction head of the mixing box vacuum tube centered therein for receiving the loosened sediment.

10. The cleaning system as described in claim 7 wherein the mixing box includes an air and steam mixing chamber therein, the mixing chamber for receiving and mixing together the high pressure air and the high pressure steam prior to exiting out the front of the mixing box.

11. The cleaning system as described in claim 7 wherein the mixing box includes at least one Teflon pad mounted on a bottom of the mixing box for preventing a potential spark during the tank cleaning operation.

12. A no-entry bulk oil storage tank cleaning system adapted for receipt through a door opening in a side of a storage tank and removing sediment on a floor of the tank, for safety, the operator of the cleaning system remains outside the storage tank and next to the door opening, the cleaning system comprising:

an air line adapted for delivering high pressure air inside the tank;

a steam line adapted for delivering high pressure and high temperature steam inside the tank;

a rail vacuum pipe adapted for delivering a large vacuum inside the tank, a portion of the air line and a portion of the steam line attached to the rail vacuum pipe; and a floor finishing head adapted for receipt through the door opening and engaging the remaining sediment on the floor of the tank, the finishing head including at least one air nozzle attached to the air line, at least one steam nozzle attached to the steam line and a vacuum hose connected to the rail vacuum pipe;

whereby when the high pressure air and the high pressure steam are received through the air and steam nozzles and directed downwardly, the air and steam nozzles engage and loosen the remaining sediment, the vacuum hose vacuuming the loosened sediment into the rail vacuum pipe; and means for guiding the floor finishing head with attached air and steam lines and rail vacuum pipe back and forth and side to side inside the tank.

13. The cleaning system as described in claim 12 wherein the floor finishing head is wheel mounted for moving the finishing head back and forth on the tank floor.

14. The cleaning system as described in claim 12 wherein the floor finishing head includes an air manifold connected to the air line, the air manifold connected to a plurality of air nozzles, the air nozzles mounted in a front of a finishing head housing and directed downwardly and rearwardly toward a suction head of the vacuum hose mounted in a rear of the finishing housing.

15. The cleaning system as described in claim 12 wherein the floor finishing head includes a steam manifold connected to the steam line, the steam manifold connected to a plurality of steam nozzles, the steam nozzles mounted in a front of a finishing head housing and directed downwardly and rearwardly toward a suction head of the vacuum hose mounted in a rear of the finishing housing.

16. The cleaning system as described in claim 12 wherein the means for guiding the floor finishing head includes a steering guide rail mounted along a length of the rail vacuum pipe and a swivel wheel mounted on a door opening bracket, the door opening bracket adapted for attachment to opposite sides of the door opening, the steering guide rail received on the swivel wheel and moved back and forth thereon during the operation of the tank cleaning system.

* * * * *